US008136309B2

(12) United States Patent
Rahimian

(10) Patent No.: US 8,136,309 B2
(45) **Date of Patent: *Mar. 20, 2012**

(54) ENERGY DISSIPATION DAMPER SYSTEM IN STRUCTURE SUBJECT TO DYNAMIC LOADING

(76) Inventor: Ahmad Rahimian, New York, NY (US)

( * ) Notice: Subject to any disclaimer, the term of this patent is extended or adjusted under 35 U.S.C. 154(b) by 265 days.

This patent is subject to a terminal disclaimer.

(21) Appl. No.: 12/646,202

(22) Filed: Dec. 23, 2009

(65) Prior Publication Data

US 2010/0313496 A1 Dec. 16, 2010

Related U.S. Application Data

(60) Provisional application No. 61/187,089, filed on Jun. 15, 2009.

(51) Int. Cl.
*E04B 1/98* (2006.01)

(52) U.S. Cl. ..... 52/167.3; 52/741.3; 52/638; 188/380; 267/182

(58) Field of Classification Search ..... 52/167.3, 52/167.1, 167.4, 167.7, 167.8, 167.9, 167.2, 52/638, 741.1, 741.3; 248/638; 188/378, 188/379, 380; 267/182
See application file for complete search history.

(56) References Cited

U.S. PATENT DOCUMENTS

| | | | | | |
|---|---|---|---|---|---|
| 3,796,017 | A * | 3/1974 | Meckler | 52/292 |
| 4,409,765 | A * | 10/1983 | Pall | 52/167.1 |
| 4,577,826 | A * | 3/1986 | Bergstrom et al. | 248/638 |
| 4,890,430 | A * | 1/1990 | Kobori et al. | 52/167.3 |
| 4,922,667 | A * | 5/1990 | Kobori et al. | 52/167.2 |
| 5,316,240 | A * | 5/1994 | Girard et al. | 244/17.27 |
| 5,375,382 | A * | 12/1994 | Weidlinger | 52/167.3 |
| 5,491,938 | A * | 2/1996 | Niwa et al. | 52/167.1 |
| 5,727,663 | A * | 3/1998 | Taylor | 188/378 |
| 5,870,863 | A * | 2/1999 | Taylor | 52/167.3 |
| 6,170,202 | B1 * | 1/2001 | Davoodi et al. | 52/167.1 |
| 6,192,637 | B1 * | 2/2001 | Boilen et al. | 52/167.3 |
| 6,247,275 | B1 * | 6/2001 | Taylor | 52/167.3 |
| 6,397,528 | B1 * | 6/2002 | Rahimian | 52/167.1 |
| 6,530,182 | B2 * | 3/2003 | Fanucci et al. | 52/167.3 |
| 6,651,395 | B2 * | 11/2003 | Capra | 52/167.8 |
| 2001/0045069 | A1 * | 11/2001 | Constantinou | 52/167.3 |

FOREIGN PATENT DOCUMENTS

| | | | |
|---|---|---|---|
| JP | 53019657 | A * | 2/1978 |
| JP | 01284639 | A * | 11/1989 |
| JP | 01318629 | A * | 12/1989 |
| JP | 02080770 | A * | 3/1990 |
| JP | 02164953 | A * | 6/1990 |
| JP | 02286935 | A * | 11/1990 |

* cited by examiner

*Primary Examiner* — Robert Canfield
*Assistant Examiner* — Babajide Demuren
(74) *Attorney, Agent, or Firm* — Kirschstein, et al.

(57) ABSTRACT

A damper system for installation in a structure to dissipate seismic and wind energy transmitted to the structure, includes first and second pairs of elongated members forming an outer parallelogram, third and fourth pairs of elongated members forming an inner parallelogram, and a pair of energy dissipating devices connected between the parallelograms for dissipating the energy transmitted to the structure.

19 Claims, 3 Drawing Sheets

ENERGY DISSIPATION DAMPER SYSTEM IN STRUCTURE SUBJECT TO DYNAMIC LOADING

CROSS-REFERENCE TO RELATED APPLICATION

This application claims the benefit of U.S. Provisional Patent Application Ser. No. 61/187,089, filed Jun. 15, 2009, which is hereby incorporated by reference herein.

DESCRIPTION OF THE RELATED ART

This invention generally relates to structural design and construction and, more particularly, to an improved energy dissipation damper system for inclusion in structures to protect the structures in the event of earthquake, wind and other dynamic loadings or excitations.

Building codes accept the introduction of energy dissipation damper systems within a building structure to reduce dynamic effects due, for example, to earthquake or wind, to within acceptable limits. One type of damper system is a diagonal brace incorporating a viscous damper placed diagonally in a frame of the building structure. Another type of damper system is a chevron brace placed in a V-shaped configuration in the frame. Still another type of damper system, as disclosed in U.S. Pat. No. 6,438,905, is a scissor-jack placed in the frame and having a plurality of braces arranged in a parallelogram-shaped configuration and incorporating a viscous damper placed diagonally across the parallelogram.

The dynamic loading that is resisted and absorbed by the foregoing damper systems is due to the horizontal displacement between two adjacent floors of a building structure, or between various levels of other structures, such as bridges. However, the inter-story displacement of structures that will be sensed by the ends of the damper is relatively very small, thereby requiring large, heavy, short-stroke (less than a fraction of an inch) viscous dampers, thus making the viscous dampers relatively expensive and less effective. To reduce the damper size and cost, and/or to increase the damper effectiveness, it would be desirable to use relatively inexpensive, long-stroke (greater than a fraction of an inch) dampers. This can be accomplished by magnifying the relative motions at the ends of the damper caused by the relatively small displacement between the levels or floors of a structure, that is, to provide a motion sensed by the damper that is larger than the motion produced by a change in length of a diagonal brace, or by the movement of a chevron brace or a scissors-jack.

SUMMARY OF THE INVENTION

One feature of this invention resides, briefly stated, in a damper system for installation in a structure to dissipate energy transmitted to the structure. The damper system includes a first pair of elongated members of equal length and extending from a first node on the structure, a second pair of elongated members of equal length and extending from a second node spaced from the first node on the structure, a first pivot joint for pivotally connecting a distal end of one of the first pair of elongated members to a distal end of one of the second pair of elongated members, and a second pivot joint opposite the first pivot joint for pivotally connecting a distal end of the other of the first pair of elongated members to a distal end of the other of the second pair of elongated members. The first and second pairs of elongated members can be of equal or unequal lengths and form an outer parallelogram, with the nodes and the first and second pivot joints being situated at corners of the outer parallelogram.

The damper system further includes a third pair of elongated members of equal length and extending from the first pivot joint, a fourth pair of elongated members of equal length and extending from the second pivot joint, a third pivot joint for pivotally connecting a distal end of one of the third pair of elongated members to a distal end of one of the fourth pair of elongated members, and a fourth pivot joint opposite the third pivot joint for pivotally connecting a distal end of the other of the third pair of elongated members to a distal end of the other of the fourth pair of elongated members. The third and fourth pairs of elongated members can be of equal or unequal lengths and form an inner parallelogram, with all the pivot joints being situated at corners of the inner parallelogram.

The damper system still further includes an energy dissipating device, and preferably a pair of energy dissipating devices, each connected between one of the nodes and one of the third and fourth pivot joints for dissipating the energy transmitted to the structure. The nodes are situated at different levels, floors, or elevations in the structure and are spaced apart along an axis. The energy dissipating devices are elongated and extend along the axis between the outer and the inner parallelograms. Each energy dissipating device is preferably a viscous damper, a viscoelastic damper, a friction damper, or a hysteretic damper in general. All the elongated members and the energy dissipating devices lie in a common plane.

The damper system essentially magnifies relatively small displacements between levels of the structure, and provides a motion transmitted to the damper at the ends of the damper that is larger than the motion produced by a change in length of a diagonal brace, or by the movement of a chevron brace or a scissors-jack. Thus, the damper system of this invention permits the use of relatively inexpensive, long-stroke, relatively light, lower capacity dampers and also permits the use of other types of long-stroke shock absorbers.

Another feature of this invention resides, briefly stated, in an energy dissipating structure, which comprises a structural frame having levels of different elevation, and a damper system, as described above, installed between the levels.

Still another feature of this invention resides, briefly stated, in a method of dissipating energy transmitted to a structure, the method being performed by connecting a first pair of elongated members of equal length to a first node on the structure, connecting a second pair of elongated members of equal length to a second node spaced from the first node on the structure, pivotally connecting a distal end of one of the first pair of elongated members to a distal end of one of the second pair of elongated members at a first pivot joint, pivotally connecting a distal end of the other of the first pair of elongated members to a distal end of the other of the second pair of elongated members at a second pivot joint opposite the first pivot joint, connecting a third pair of elongated members of equal length to the first pivot joint, connecting a fourth pair of elongated members of equal length to the second pivot joint, pivotally connecting a distal end of one of the third pair of elongated members to a distal end of one of the fourth pair of elongated members at a third pivot joint, pivotally connecting a distal end of the other of the third pair of elongated members to a distal end of the other of the fourth pair of elongated members at a fourth pivot joint opposite the third pivot joint, and connecting one energy dissipating device, and preferably two energy dissipating devices, between one of the nodes and one of the third and fourth pivot joints for dissipating the energy transmitted to the structure.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
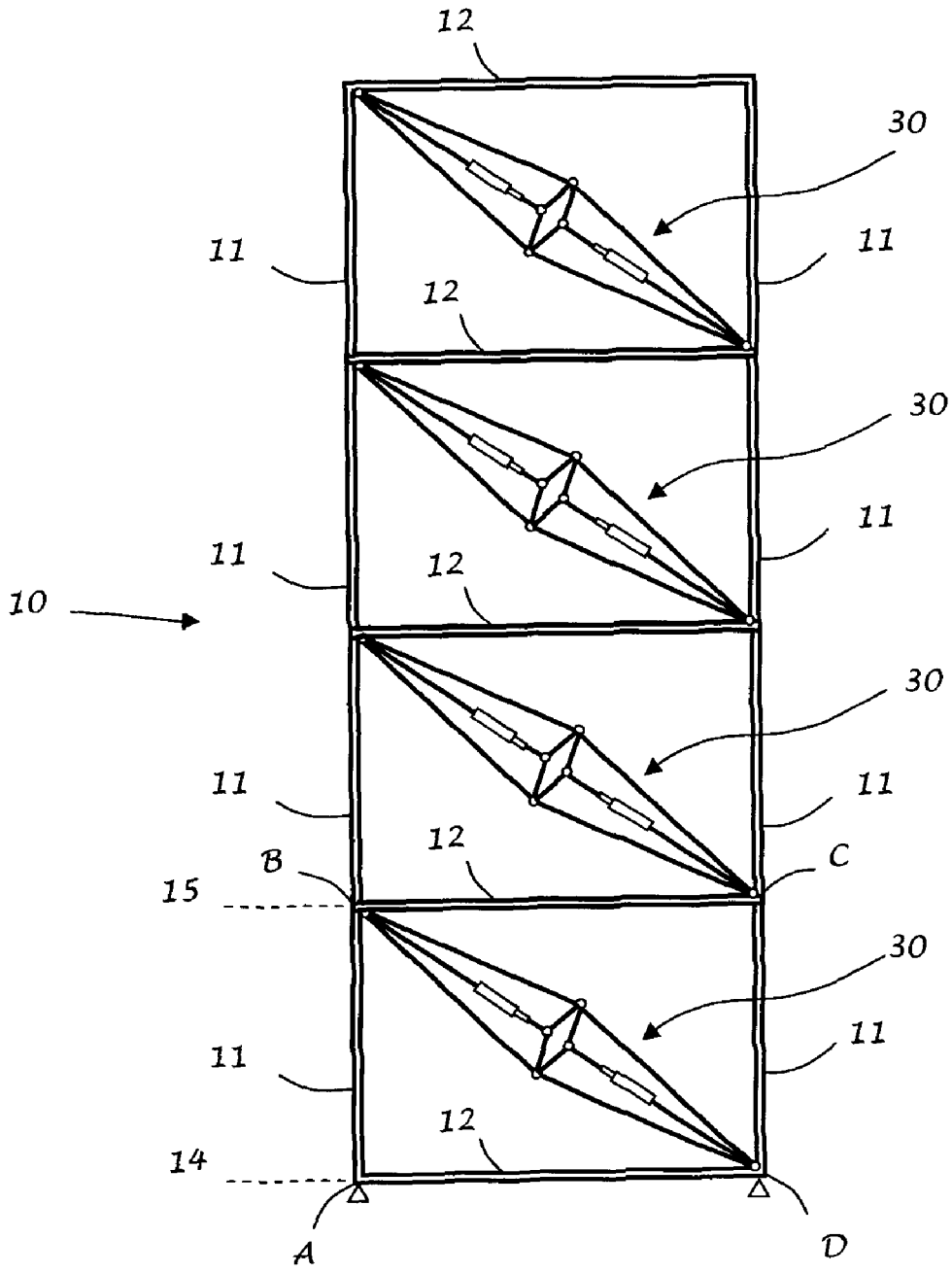
FIG. 1 is an elevational view of a plurality of damper systems in accordance with the present invention installed in a building structure.

Reference numeral 10 in FIG. 1 generally identifies a structure, such as a multi-floor building, each floor having an installed damper system 30 in accordance with this invention for dissipating energy, such as seismic or wind forces, transmitted to the structure. The structure 10 has a framework having vertical columns 11 and horizontal beams 12 joined to the columns. The framework has a plurality of floors or bays stacked one above another, and the lowermost floor is representative and has nodes A, B, C and D at its four corners. Reference numeral 14 identifies a lower level or elevation of the structure 10, and reference numeral 15 identifies a higher level or elevation of the structure 10. Other structures are, of course, contemplated by this invention, including structures that are not buildings, such as bridges.

Figure 2:
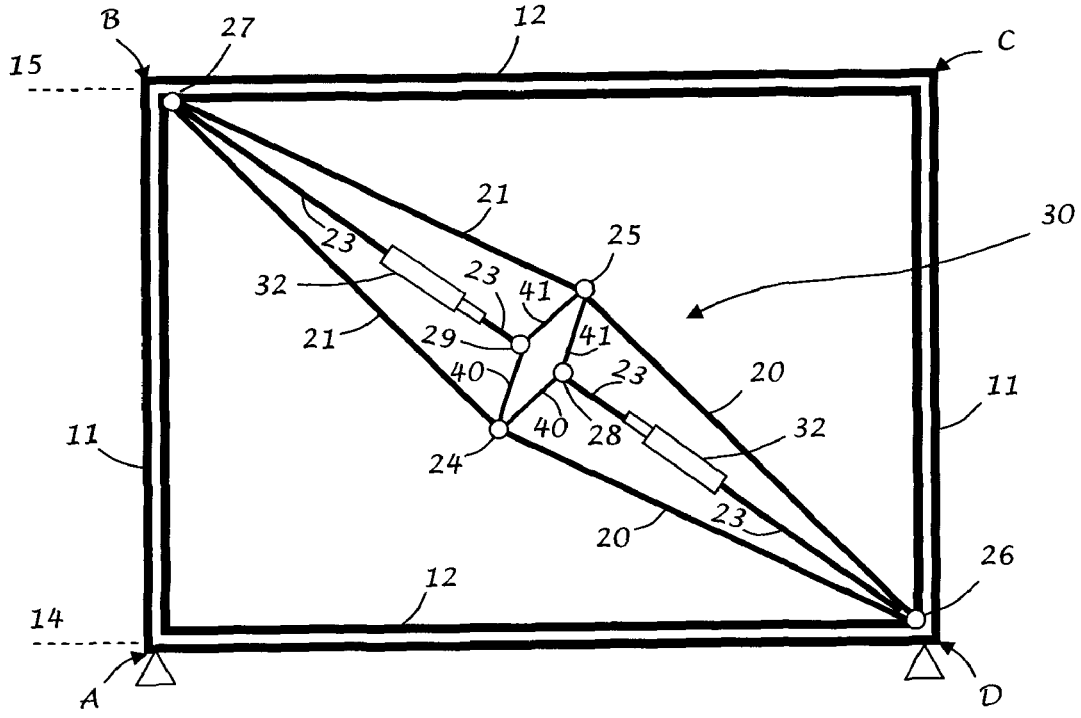
FIG. 2 is an enlarged view of a representative damper system of FIG. 1.

As best seen in FIG. 2 for the representative lowermost floor, each damper system 30 includes a first pair of elongated members or links 20 of equal length and extending from a first node D at a pivot 26 on the structure 10, a second pair of elongated members or links 21 of equal length and extending from a second node B at a pivot 27 spaced from the first node D on the structure 10, a first pivot joint 24 for pivotally connecting a distal end of one of the first pair of elongated members 20 to a distal end of one of the second pair of elongated members 21, and a second pivot joint 25 opposite the first pivot joint 24 for pivotally connecting a distal end of the other of the first pair of elongated members 20 to a distal end of the other of the second pair of elongated members 21. The first and second pairs of elongated members 20, 21 are all of equal lengths as shown, but can also be of unequal lengths, and form an outer parallelogram, with the nodes B, D and the first and second pivot joints 24, 25 being situated at corners of the outer parallelogram.

Each damper system 30 further includes a third pair of elongated members or links 40 of equal length and extending from the first pivot joint 24, a fourth pair of elongated members or links 41 of equal length and extending from the second pivot joint 25, a third pivot joint 28 for pivotally connecting a distal end of one of the third pair of elongated members 40 to a distal end of one of the fourth pair of elongated members 41, and a fourth pivot joint 29 opposite the third pivot joint 28 for pivotally connecting a distal end of the other of the third pair of elongated members 40 to a distal end of the other of the fourth pair of elongated members 41. The third and fourth pairs of elongated members 40, 41 are all of equal lengths as shown, but can also be of unequal lengths, and form an inner parallelogram, with all the pivot joints 24, 25, 28, 29 being situated at corners of the inner parallelogram. All pivot joints at 24, 25, 26, 27, 28, 29 are all hinged or are flexible connections to allow in-plane rotational movement between the members.

Each damper system 30 further includes an energy dissipating device 32, and preferably a pair of energy dissipating devices 32, each connected between one of the nodes B, D and one of the third and fourth pivot joints 28, 29 for dissipating the energy transmitted to the structure 10. The nodes B, D are situated at different levels, floors, or elevations 14, 15 in the structure 10 and are spaced apart along an axis. As shown, the axis is a diagonal extending between nodes B, D. The energy dissipating devices 32 are elongated and extend along the axis between the outer and the inner parallelograms. Extensions 23 can be provided to help span the distances between the outer and the inner parallelograms. Each energy dissipating device 32 is preferably a viscous damper, a viscoelastic damper, a friction damper, or a hysteretic damper in general. All the elongated members 20, 21, 40, 41 and the energy dissipating devices 32 lie in a common plane.

Each damper system 30 essentially magnifies relatively small displacements between levels of the structure 10, and provides a motion transmitted to the damper at the ends of the damper that is larger than the motion produced by a change in length of a diagonal brace, or by the movement of a chevron brace or a scissors-jack. Thus, the damper system of this invention permits the use of relatively inexpensive, long-stroke, relatively light, lower capacity dampers 32 and also permits the use of other types of long-stroke shock absorbers.

Figure 3:
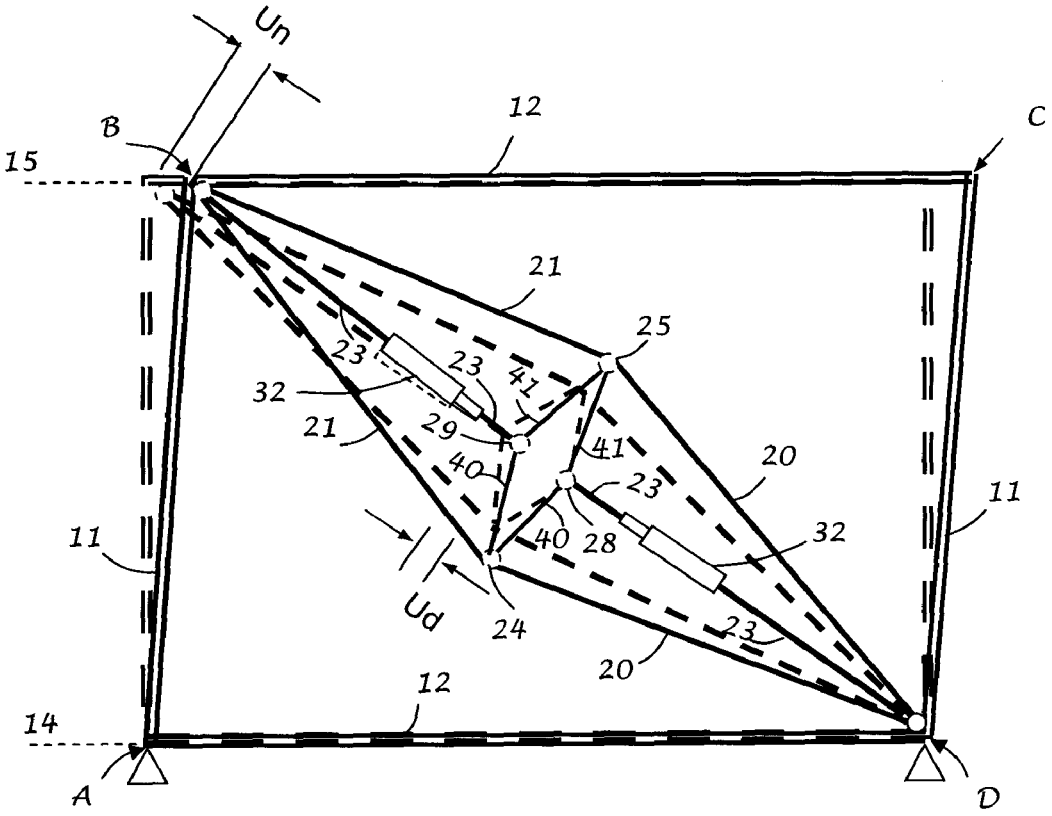
FIG. 3 is a view analogous to FIG. 2 and showing the effects of dynamic loading.

More specifically, as shown in FIG. 3, each damper system 30 is displaced when subjected to the dynamic loading effect of an earthquake or wind. The node B is displaced horizontally by a nodal displacement distance Un, and the dampers 32 are displaced by a damper displacement distance Ud. A system amplification factor (f) can be defined as a ratio of (Ud/Un). The system amplification factor of the damper system 30 is an order of magnitude greater than the system amplification factor of the known diagonal brace, chevron brace or scissors-jack systems, thus proportionally manifestly demonstrating the effectiveness and superiority of the instant invention over the known systems of the prior art.

It will be understood that each of the elements described above, or two or more together, also may find a useful application in other types of constructions differing from the types described above. For example, the damper system can be applied to any type of structure 10 using any type of construction materials, for example, the damper system 30 can be applied to a steel, concrete, masonry, or composite, structure, or any combination of such materials. Steel is preferred for the elongated members and pivot joints of the damper system, but other metallic materials, such as aluminum, or a composite material may be utilized. The damper system 30 can be installed either on-site or off-site.

While the invention has been illustrated and described as embodied in an energy dissipation damper system in a structure subject to dynamic loading, it is not intended to be limited to the details shown, since various modifications and structural changes may be made without departing in any way from the spirit of the present invention. For example, the damper system 30 need not span the entire distance between corner nodes B, D, but need only span the distance between adjacent floor beams 12. Thus, more than one damper system can be provided in a single bay. Also, every floor need not have its own damper system, and some floors may be skipped. Myriad different arrangements of damper systems in combination with structural walls or trusses are contemplated.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A damper system for installation in a structure to dissipate energy transmitted to the structure, comprising:

a first pair of elongated members of equal length and extending from a first node on the structure;

a second pair of elongated members of equal length and extending from a second node spaced from the first node on the structure;

a first pivot joint for pivotally connecting a distal end of one of the first pair of elongated members to a distal end of one of the second pair of elongated members;

a second pivot joint opposite the first pivot joint for pivotally connecting a distal end of the other of the first pair of elongated members to a distal end of the other of the second pair of elongated members;

a third pair of elongated members of equal length and extending from the first pivot joint;

a fourth pair of elongated members of equal length and extending from the second pivot joint;

a third pivot joint for pivotally connecting a distal end of one of the third pair of elongated members to a distal end of one of the fourth pair of elongated members;

a fourth pivot joint opposite the third pivot joint for pivotally connecting a distal end of the other of the third pair of elongated members to a distal end of the other of the fourth pair of elongated members; and an energy dissipating device connected between one of the nodes and one of the third and fourth pivot joints for dissipating the energy transmitted to the structure.

2. The damper system of claim 1, and another energy dissipating device connected between the other of the nodes and the other of the third and fourth pivot joints for dissipating the energy transmitted to the structure.

3. The damper system of claim 2, wherein the nodes are situated at different elevations in the structure and are spaced apart along an axis, and wherein the energy dissipating devices are elongated and extend along the axis.

4. The damper system of claim 1, wherein the third and fourth pairs of elongated members form a parallelogram, and wherein the pivot joints are situated at corners of the parallelogram.

5. The damper system of claim 1, wherein all the elongated members lie in a common plane.

6. The damper system of claim 1, wherein the energy dissipating device is one of a viscous damper, a viscoelastic damper, a friction damper and a hysteretic damper.

7. The damper system of claim 1, wherein each length of the first pair of elongated members is about equal to each length of the second pair of elongated members.

8. The damper system of claim 1, wherein each length of the third pair of elongated members is about equal to each length of the fourth pair of elongated members.

9. An energy dissipating structure, comprising:

a structural frame having levels of different elevation; and a damper system installed between the levels, the damper system including a first pair of elongated members of equal length and extending from a first node on one level of the structure;

a second pair of elongated members of equal length and extending from a second node spaced from the first node on another level of the structure;

a first pivot joint for pivotally connecting a distal end of one of the first pair of elongated members to a distal end of one of the second pair of elongated members;

a second pivot joint opposite the first pivot joint for pivotally connecting a distal end of the other of the first pair of elongated members to a distal end of the other of the second pair of elongated members;

a third pair of elongated members of equal length and extending from the first pivot joint;

a fourth pair of elongated members of equal length and extending from the second pivot joint;

a third pivot joint for pivotally connecting a distal end of one of the third pair of elongated members to a distal end of one of the fourth pair of elongated members;

a fourth pivot joint opposite the third pivot joint for pivotally connecting a distal end of the other of the third pair of elongated members to a distal end of the other of the fourth pair of elongated members; and an energy dissipating device connected between one of the nodes and one of the third and fourth pivot joints for dissipating energy transmitted to the structure.

10. The energy dissipating structure of claim 9, and another energy dissipating device connected between the other of the nodes and the other of the third and fourth pivot joints for dissipating the energy transmitted to the structure.

11. The energy dissipating structure of claim 10, wherein the nodes are spaced apart along an axis, and wherein the energy dissipating devices are elongated and extend along the axis.

12. The energy dissipating structure of claim 9, wherein the third and fourth pairs of elongated members form a parallelogram, and wherein the pivot joints are situated at corners of the parallelogram.

13. The energy dissipating structure of claim 9, wherein all the elongated members lie in a common plane.

14. The energy dissipating structure of claim 9, wherein the energy dissipating device is one of a viscous damper, a viscoelastic damper, a friction damper and a hysteretic damper.

15. The energy dissipating structure of claim 9, wherein each length of the first pair of elongated members is about equal to each length of the second pair of elongated members.

16. The energy dissipating structure of claim 9, wherein each length of the third pair of elongated members is about equal to each length of the fourth pair of elongated members.

17. A method of dissipating energy transmitted to a structure, comprising the steps of:

connecting a first pair of elongated members of equal length to a first node on the structure;

connecting a second pair of elongated members of equal length to a second node spaced from the first node on the structure;

pivotally connecting a distal end of one of the first pair of elongated members to a distal end of one of the second pair of elongated members at a first pivot joint;

pivotally connecting a distal end of the other of the first pair of elongated members to a distal end of the other of the second pair of elongated members at a second pivot joint opposite the first pivot joint;

connecting a third pair of elongated members of equal length to the first pivot joint;

connecting a fourth pair of elongated members of equal length to the second pivot joint;

pivotally connecting a distal end of one of the third pair of elongated members to a distal end of one of the fourth pair of elongated members at a third pivot joint;

pivotally connecting a distal end of the other of the third pair of elongated members to a distal end of the other of the fourth pair of elongated members at a fourth pivot joint opposite the third pivot joint; and connecting an energy dissipating device between one of the nodes and one of the third and fourth pivot joints for dissipating the energy transmitted to the structure.

18. The method of claim 17, and connecting another energy dissipating device between the other of the nodes and the other of the third and fourth pivot joints for dissipating the energy transmitted to the structure.

19. The method of claim 18, and situating the nodes at different elevations in the structure and spacing the nodes apart along an axis, and connecting the energy dissipating devices to extend along the axis.

* * * * *